US009168451B2

(12) United States Patent
Horikawa

(10) Patent No.: US 9,168,451 B2
(45) Date of Patent: Oct. 27, 2015

(54) GAME-PIECE LAUNCHING TOY

(75) Inventor: Akira Horikawa, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 14/345,624

(22) PCT Filed: Jan. 30, 2012

(86) PCT No.: PCT/JP2012/051983

§ 371 (c)(1),
(2), (4) Date: Mar. 18, 2014

(87) PCT Pub. No.: WO2013/114534

PCT Pub. Date: Aug. 8, 2013

(65) Prior Publication Data

US 2014/0346729 A1 Nov. 27, 2014

(51) Int. Cl.

| | |
|---|---|
| ***A63H 33/18*** | (2006.01) |
| ***A63F 7/24*** | (2006.01) |
| ***A63H 33/00*** | (2006.01) |

(52) U.S. Cl.

CPC ..... *A63F 7/2472* (2013.01); *A63F 7/2409* (2013.01); *A63H 33/00* (2013.01)

(58) Field of Classification Search

CPC ..... A63F 7/22; A63F 7/24; A63F 7/2472; A63F 7/2409; A63F 7/00; A63F 7/0005; A63F 7/0017; A63F 7/0023; A63H 33/00; A63H 33/18

USPC ..... 273/317, 129 R, 129 S, 129 T, 129 V, 273/129 W; 124/1, 16, 79

See application file for complete search history.

(56) References Cited

U.S. PATENT DOCUMENTS

| | | | | | |
|---|---|---|---|---|---|
| 3,300,215 | A * | 1/1967 | Coffey, Sr. | ..... | 273/394 |
| 4,203,603 | A * | 5/1980 | Konta | ..... | 273/129 W |
| 4,333,651 | A * | 6/1982 | Ingels | ..... | 273/129 V |
| 4,978,124 | A * | 12/1990 | Brown et al. | ..... | 273/129 S |
| 5,088,736 | A * | 2/1992 | Chuang | ..... | 273/121 R |
| 5,711,522 | A * | 1/1998 | Wiggs et al. | ..... | 273/129 S |
| 2014/0346729 | A1 * | 11/2014 | Horikawa | ..... | 273/129 R |

FOREIGN PATENT DOCUMENTS

| | | | | |
|---|---|---|---|---|
| CN | 201431768 | | 3/2010 | |
| DE | 202009000267 | | 3/2009 | |
| JP | 08173643 | A * | 7/1996 | ..... A63H 33/18 |

(Continued)

OTHER PUBLICATIONS

International Search Report for International Application No. PCT/JP2012/051983, mailed Apr. 10, 2012.

(Continued)

*Primary Examiner* — Raleigh W Chiu
(74) *Attorney, Agent, or Firm* — Nixon Peabody LLP

(57) ABSTRACT

This game-piece launching toy, which is a toy used while playing games in which game-pieces such as marbles are launched, includes a toy body; a flipping member installed on the toy body; a pushing member configured to move a game-piece placed on the toy body toward a tip of the flipping member; and a restriction member installed on the toy body to be movable with respect to the toy body and operated by a user to restrict the flipping member. The game-piece loaded into the toy body is launched from the toy body using a restriction force acting on the flipping member.

10 Claims, 10 Drawing Sheets

(56) References Cited

FOREIGN PATENT DOCUMENTS

| | | | | | |
|---|---|---|---|---|---|
| JP | 08280945 | A | * | 10/1996 | ..... A63H 33/18 |
| JP | 09047584 | A | * | 2/1997 | ..... A63H 33/18 |
| JP | 09299621 | A | * | 11/1997 | ..... A63H 33/18 |
| JP | 3045638 | U | | 2/1998 | |
| JP | 3149333 | B2 | | 3/2001 | |
| JP | 2003190666 | A | * | 7/2003 | ..... A63H 33/18 |
| JP | 2005-152026 | A | | 6/2005 | |
| JP | 2005261631 | A | * | 9/2005 | ..... A63H 33/18 |
| JP | 2006051054 | A | * | 2/2006 | ..... A63H 33/18 |
| JP | 2006136505 | A | * | 6/2006 | ..... A63H 33/18 |
| JP | 3160233 | U | | 6/2010 | |
| WO | 2005/000415 | | | 1/2005 | |

OTHER PUBLICATIONS

Supplementry European Search Report issued in EP Application No. 12867243.3 dated Jul. 3, 2015.

* cited by examiner

GAME-PIECE LAUNCHING TOY

CROSS-REFERENCE TO RELATED PATENT APPLICATION

The present application is a National Stage Application of International Application No. PCT/JP2012/051983 entitled "Gamepiece Flicking Toy" filed Jan. 30, 2012, the contents of which is incorporated herein by reference in its entirety.

TECHNICAL FIELD

The present invention relates to a game-piece launching toy used while playing games in which game-pieces such as marbles are launched.

BACKGROUND ART

A launching toy used while playing games in which spherical bodies such as marbles are launched is disclosed in the following PTL 1. This launching toy includes a toy body, a pair of flipping members provided on the toy body, and a pushing member that pushes out a spherical body placed between the flipping members. The pair of flipping members correspond to two tip portions that make a pair of circular-arc-shaped members. The distance between the tips of the flipping members is less than the diameter of the spherical body.

A user first places the spherical body between the flipping members and moves the spherical body toward the tips of the flipping member using the pushing member while holding down the toy body with the hands. In the process in which the spherical body moves toward the tips of the flipping member, the distance between the tips of the flipping members is increased against the elastic forces of the tips. If the spherical body is further moved toward the tips of the flipping members, the spherical body is eventually launched from between the flipping members by the elastic restoring forces of the flipping members.

CITATION LIST

Patent Literature

PTL 1: Japanese Patent No. 3149333

SUMMARY OF INVENTION

Technical Problem

In the aforementioned launching toy, the force launching the spherical body is almost dependent on the elastic restoring forces of the flipping members. Therefore, the force launching the spherical body from the toy body is approximately constant, and the speed of the spherical body launched from the toy body is also approximately constant.

Solution to Problem

A game-piece launching toy of the invention includes: a toy body; a flipping member installed on the toy body; a pushing member configured to move a game-piece placed on the toy body toward a tip of the flipping member; and a restriction member installed on the toy body to be movable with respect to the toy body and operated by a user to restrict the flipping member. The game-piece loaded into the toy body is launched from the toy body by a restriction force acting on the flipping member.

A user first loads the game-piece used for play into the toy body, operates the restriction member while holding down the toy body with the hands, and restricts the tip of the flipping member. Then, the game-piece is moved toward the tip of the flipping member using the pushing member. Meanwhile, since the tip of the flipping member is restricted by the user's hands via the restriction member, a force checking the movement of the game-piece using the pushing member is generated. If the game-piece is further moved toward the tip of the flipping member against this force, the tip of the flipping member is displaced against a restriction force generated by the user's hands. Then, if the center of the game-piece moves further forward than a contact point between the flipping member and the game-piece, the game-piece is launched from the toy body by the restriction force acting on the flipping member by the user's hands.

In the invention, the toy body may be provided with a pair of the flipping members, and only one flipping member may be provided on the toy body. When the pair of flipping members are provided, the restriction member restricts the pair of the flipping members so as to make the distance between tips of the flipping members less than the breadth of the game-piece. For example, if a spherical body is used as the game-piece, a restriction member restricts the flipping member so as to make the distance between the tips of the flipping member less than the diameter of the spherical body.

When only one flipping member is provided on the toy body, the restriction member restricts the tip of the flipping member so as to make the spacing between the toy body having the game-piece placed thereon and the tip of the flipping member less than the breadth of the game-piece.

Advantageous Effects of Invention

According to the invention, when a user operates the restriction member while holding down the game-piece launching toy with their hands, the restriction force acting on the flipping member can be adjusted by adjusting the force input to the restriction member by the user's hands. Accordingly, since the user can arbitrarily adjust the force launching the game-piece from the toy body, changes can be made to the speed of the game-piece to be launched from the toy body. As a result, the range of play using the game-piece launching toy is broad, and the user's enjoyment is enhanced.

DESCRIPTION OF EMBODIMENTS

First Embodiment

A first embodiment of a game-piece launching toy of the invention, which is shown in FIG. 1 to FIGS. 3A and 3B, will be described below.

Figure 1:
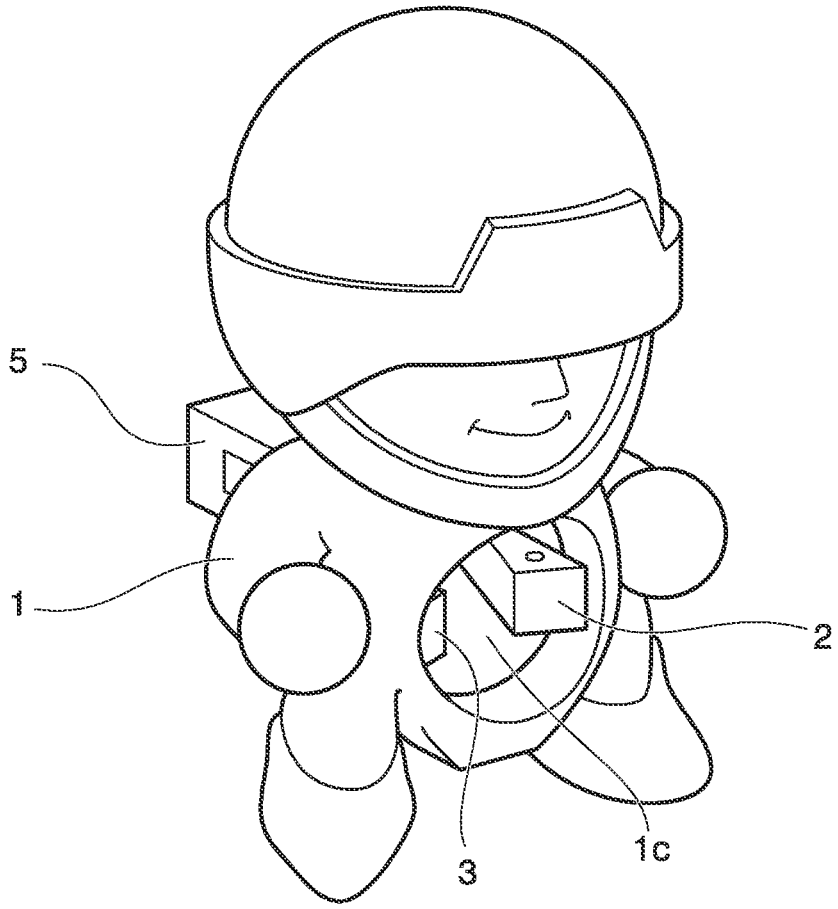
FIG. 1 is an overall view showing a first embodiment of a game-piece launching toy of the invention.
Figure 2:
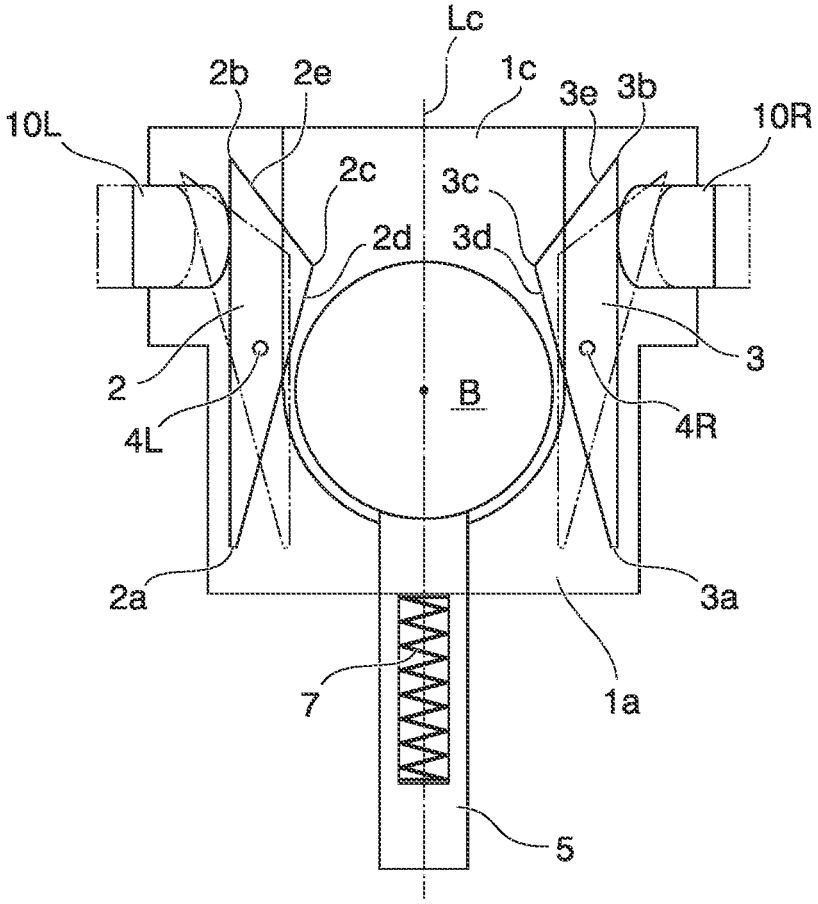
FIG. 2 is a plan cross-sectional view of the first embodiment of the game-piece launching toy shown in FIG. 1.

As shown in FIGS. 1 and 2, the first embodiment of the invention includes, a toy body 1 that, for example, imitates a character of an animation, a pair of flipping members 2 and 3 that launches a spherical body B as a game-piece used for play, a pushing member 5 that pushes the spherical body B loaded into the toy body 1, and restriction members 10L and 10R that restrict tips of the flipping members 2 and 3, respectively. All of the flipping members 2 and 3, the pushing member 5, and the restriction members 10L and 10R are attached to the toy body 1.

The toy body 1 can be disassembled into several parts including a base 1*a*. As shown in FIG. 2, the base 1*a* is formed with a launching port 1*c* of the spherical body B. The flipping members 2 and 3 are respectively disposed on both sides of the launching port 1*c*.

The flipping member 2 is pivotally supported within an imaginary horizontal plane by a pin 4L fixed to the base 1*a*, on the left side of the launching port 1*c* in a direction in which the spherical body B is launched, that is, in the launching direction of the spherical body B. The flipping member 2 is formed so that the width thereof increases gradually from a base end 2*a* toward a tip 2*b* and the width thereof decreases gradually from a vertex 2*c* toward the tip 2*b*. The vertex 2*c* corresponds to the tip of a corner of the flipping member 2 that projects toward the launching port 1*c*. Both a rear oblique side 2*d* extending from the base end 2*a* toward the vertex 2*c* and a front oblique side 2*e* extending from the vertex 2*c* toward the tip 2*b* are linearly formed.

The flipping member 3 is pivotally supported within the same imaginary horizontal plane as the flipping member 2 by a pin 4R fixed to the base 1*a*, on the right side of the launching port 1*c* in the launching direction of the spherical body B. The flipping member 3 is formed so that the width thereof increases gradually from a base end 3*a* toward a tip 3*b* and the width thereof decreases gradually from a vertex 3*c* toward the tip 3*b*. The vertex 3*c* corresponds to the tip of a corner of the flipping member 3 that projects toward the launching port 1*c*. Both a rear oblique side 3*d* extending from the base end 3*a* toward the vertex 3*c* and a front oblique side 3*e* extending from the vertex 3*c* toward the tip 3*b* are linearly formed.

The flipping members 2 and 3 are arranged symmetrically with respect to a centerline Lc of the base 1*a* along the launching direction of the spherical body B. An imaginary straight line L1 connecting the vertex 2*c* of the flipping member 2 and the vertex 3*c* of the flipping member 3 is always orthogonal to the centerline Lc under the condition that the angle of the flipping member 2 to the centerline Lc is equal to the angle of the flipping member 3 to the centerline Lc.

Additionally, the spacing between the pins 4L and 4R is clearly wider than the diameter of the spherical body B, and the spherical body B loaded into the toy body 1 is movable along the launching port 1*c* between the flipping members 2 and 3 supported by the pins 4L and 4R, respectively.

The pushing member 5 is supported by a rear portion of the base 1*a* with respect to the launching port 1*c* so as to be insertable in the launching direction of the spherical body B. If the pushing member 5 is inserted into the toy body 1, a tip of the pushing member 5 projects into the launching port 1*c*, abuts against the spherical body B loaded into the launching port 1*c*, and causes the spherical body B to move toward the tips of the flipping members 2 and 3.

A spring 7 is built in the pushing member 5. A spring 7 is compressed between the base 1*a* and the pushing member 5 by inserting the pushing member 5 into the toy body 1 so as to move the spherical body B toward the tips of the flipping members 2 and 3. When the restriction on the pushing member 5 is released, the spring 7 releases the elasticity accumulated by the compression and returns the pushing member 5 to its initial position.

The restriction member 10L is disposed on the left side of the launching port 1*c* in the launching direction of the spherical body B and outside the flipping member 2 with respect to the launching port 1*c*, and is supported by the base 1*a* so as to be movable in a direction orthogonal to the launching direction of the spherical body B. If the restriction member 10L is pushed into the toy body 1 from a side thereof, a tip of the restriction member 10L abuts against an outer edge of the flipping member 2, and a tip portion of the flipping member 2 moves toward the launching port 1*c*.

The restriction member 10R is disposed on the right side of the launching port 1*c* in the launching direction of the spherical body B and outside the flipping member 3 with respect to the launching port 1*c*, and is supported by the base 1*a* so as to be movable in a direction orthogonal to the launching direction of the spherical body B. If the restriction member 10R is pushed into the toy body 1 from a side thereof, a tip of the restriction member 10R abuts against an outer edge of the flipping member 3, and a tip portion of the flipping member 3 moves toward the launching port 1*c*.

The restriction members 10L and 10R are arranged on both sides of the toy body 1 across the launching port 1*c*, and a direction in which the restriction member 10L is pushed and a direction in which the restriction member 10R is pushed are opposite to each other. If the restriction members 10L and 10R are simultaneously operated such that the toy body 1 is held with the hands, the vertex 2*c* of the flipping member 2 and the vertex 3*c* of the flipping member 3 approach each other. The flipping members 2 and 3 are restricted to a state in which the distance between the vertexes 2*c* and 3*c* is maintained to be less than the diameter of the spherical body B.

First, a user loads the spherical body B into the launching port 1*c* inside the toy body 1 placed on a base plane. Then, flipping members 2 and 3 are restricted by operating the restriction members 10L and 10R so as to be pushed into the toy body 1 from both sides of the toy body 1 while holding down the toy body 1 with the hands. Accordingly, the distance between the vertexes 2*c* and 3*c* becomes less than the diameter of the spherical body B.

Subsequently, the spherical body B loaded into the launching port 1*c* is moved toward the tips of the flipping members 2 and 3 using the pushing member 5. The spherical body B is pushed by the pushing member 5, is moved forward in the launching direction on the launching port 1*c*, and abuts against the rear oblique side 2*d* of the flipping member 2 and the rear oblique side 3*d* of the flipping member 3. Meanwhile, since the flipping members 2 and 3 are restricted by the user's hands via the restriction members 10L and 10R, forces checking the movement of the spherical body B using the pushing member 5 act on the flipping members 2 and 3. If the spherical body B is further moved toward the tips of the flipping members 2 and 3 against these forces, since the spherical body B abuts against the rear oblique sides 2*d* and 3*d* of the flipping members 2 and 3, the tip portions of the flipping members 2 and 3 are displaced against the restriction forces generated by the user's hands so as to widen the distance between the vertexes 2*c* and 3*c*. Then, if the center of the spherical body B moves forward further than the imaginary straight line L1 connecting the vertex 2*c* and the vertex 3*c*, the spherical body B abuts against the front oblique sides 2*e* and 3*e* of the flipping members 2 and 3, and is launched forward in the launching direction from the toy body 1 by the restriction forces acting on the flipping members 2 and 3 by the user's hands.

Figure 3A:
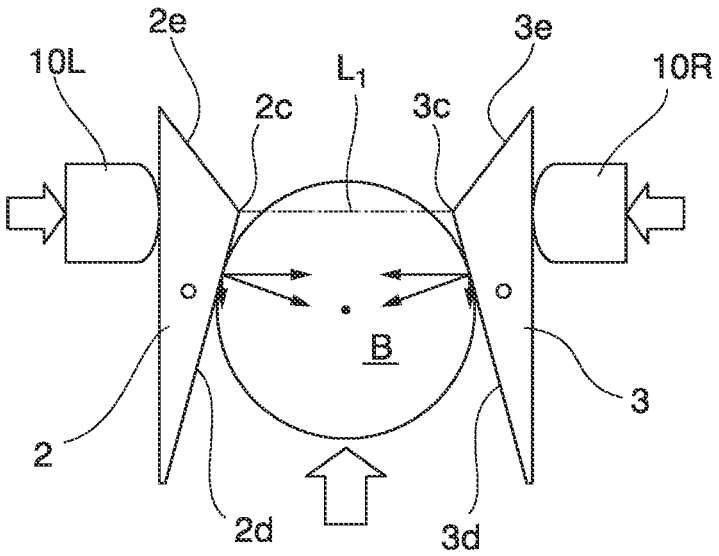
FIG. 3A is a schematic view illustrating a mechanism that launches a spherical body in the first embodiment.

To describe the mechanism in which the spherical body B is launched in more detail, as shown in FIG. 3A, first, forces acting on the spherical body B via the rear oblique sides 2*d* and 3*d* from the flipping members 2 and 3 are decomposed into components that push the spherical body B against each other in the directions orthogonal to the centerline Lc and components that push the spherical body B backward in the launching direction, to a state in which the spherical body B abuts against the rear oblique sides 2*d* and 3*d* of the flipping members 2 and 3. The total of the components that push the spherical body B backward in the launching direction is equivalent to the forces checking the movement of the spherical body B using the pushing member 5.

Figure 3B:
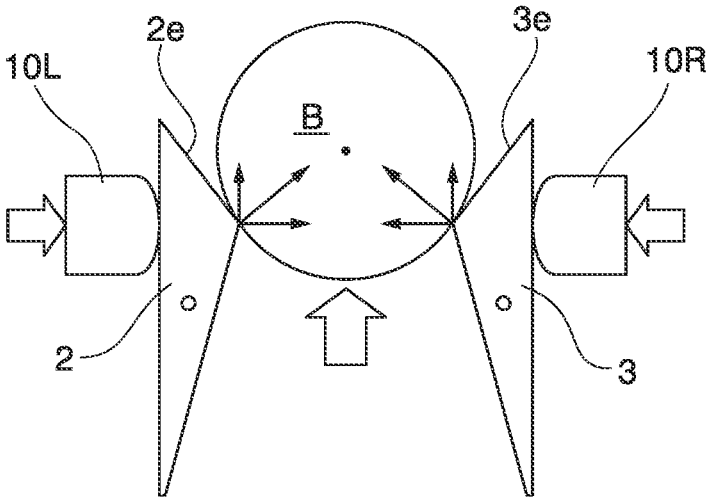
FIG. 3B is a schematic view illustrating the mechanism that launches the spherical body in the first embodiment.

As shown in FIG. 3B, if the spherical body B passes through the vertexes 2*c* and 3*c* of the flipping members 2 and 3 and abuts against the front oblique sides 2*e* and 3*e*, forces acting on the spherical body B via the front oblique sides 2*e* and 3*e* from the flipping members 2 and 3 are decomposed into components that push the spherical body B in the directions orthogonal to the centerline Lc and components that push the spherical body B forward in the launching direction. The total of the components that push the spherical body B forward in the launching direction is equivalent to a force launching the spherical body B from the toy body 1.

According to the game-piece launching toy configured as mentioned above, when a user operates the restriction members 10L and 10R while holding down the game-piece launching toy with the hands, the restriction forces acting on the flipping members 2 and 3 can be adjusted by adjusting the forces input to the restriction members 10L and 10R by the user's hands. That is, if the user holds down the game-piece launching toy strongly with the hands, the restriction members 10L and 10R are also operated with strong forces. Thus, the restriction forces acting on the flipping members 2 and 3 also become strong. Therefore, the forces pushing the spherical body B forward in the launching direction via the flipping members 2 and 3 also become strong, and consequently, the spherical body B can be quickly launched from the toy body 1.

In contrast, if the forces with which the user holds down the game-piece launching toy are weakened, the forces operating the restriction members 10L and 10R also become weaker. Thus, the restriction forces acting on the flipping members 2 and 3 also become weaker. Therefore, the forces pushing the spherical body B forward in the launching direction via the flipping members 2 and 3 also become weaker, and consequently, the spherical body B can be slowly launched from the toy body 1. In this way, since the user can arbitrarily adjust the force launching the spherical body B from the toy body 1, changes can be made to the speed of the spherical body B to be launched from the toy body 1. As a result, the range of play using the game-piece launching toy is broad, and the user's enjoyment is enhanced.

In the first embodiment of the game-piece launching toy of the invention, several modifications are present as follows. These modifications will be described below. In addition, the constituent elements already described in the first embodiment will be designated by the same reference numerals, and a detailed description thereof will be omitted here.

(First Modification)

Figure 4:
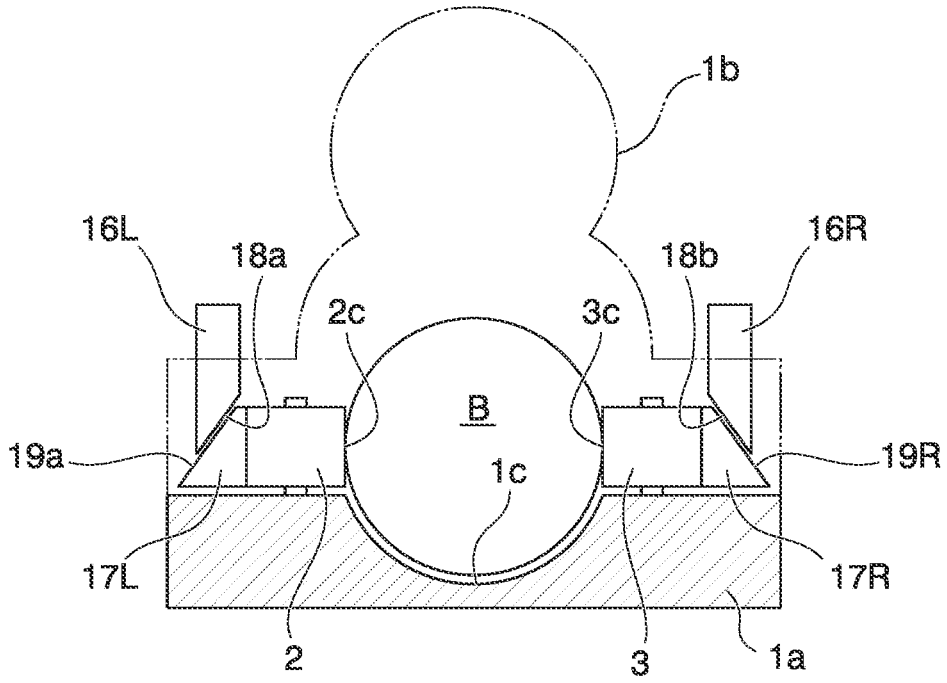
FIG. 4 is a longitudinal cross-sectional view in a width direction showing a first modification of the first embodiment.

As shown in FIG. 4, a first modification of the first embodiment includes restriction members 16L and 16R and intermediate portions 17L and 17R.

The restriction member 16L is disposed on the left side of the launching port 1*c* in the launching direction of the spherical body B and outside the flipping member 2 with respect to the launching port 1*c*, and is supported by an upper member 1*b* fixed on the base 1*a* so as to be movable in the direction (that is, the vertical direction) orthogonal to the launching direction of the spherical body B. A lower portion of the restriction member 16L is formed with a downward slope 18*a* that becomes more distant from the flipping member 2 as it goes downward.

The intermediate portion 17L is formed integrally with the flipping member 2, and projects toward the lower portion of the restriction member 16L. A side portion of the intermediate portion 17L that abuts against the slope 18*a* of the restriction member 16L is formed with an upward slope 19*a* that becomes more distant from the flipping member 2 as it goes downward. If the restriction member 16L is pushed into the toy body 1 from the top, the slope 18*a* of the restriction member 16L abuts against the slope 19*a* of the intermediate portion 17L, and downward movement of the restriction member 16L is converted into lateral movement of the flipping member 2, having the intermediate portion 17L thereat, via the slopes 18*a* and 19*a* that abut against each other. Accordingly, the tip portion of the flipping member 2 moves toward the launching port 1*c*.

The restriction member 16R is disposed on the right side of the launching port 1*c* in the launching direction of the spherical body B and outside the flipping member 3 with respect to the launching port 1*c*, and is supported by the upper member 1*b* so as to be movable in the direction (that is, the vertical direction) orthogonal to the launching direction of the spherical body B. A lower portion of the restriction member 16R is formed with a downward slope 18*b* that becomes more distant from the flipping member 3 as it goes downward.

The intermediate portion 17R is formed integrally with the flipping member 3, and projects toward the lower portion of the restriction member 16R. A side portion of the intermediate portion 17R that abuts against the slope 18*b* of the restriction member 16R is formed with an upward slope 19*b* that becomes more distant from the flipping member 3 as it goes downward. If the restriction member 16R is pushed into the toy body 1 from the top, the slope 18*b* of the restriction member 16R abuts against the slope 19*b* of the intermediate portion 17R, and downward movement of the restriction member 16R is converted into lateral movement of the flipping member 3, having the intermediate portion 17R thereat, via the slopes 18*b* and 19*b* that abut against each other. Accordingly, the tip portion of the flipping member 3 moves toward the launching port 1*c*.

The restriction members 16L and 16R are arranged on both sides of the toy body 1 across the launching port 1*c*, and a direction in which the restriction member 16L is pushed, and a direction in which the restriction member 16R is pushed coincide with each other. Therefore, it is easy to simultaneously operate the restriction members 16L and 16R. If the restriction members 16L and 16R are simultaneously operated, the vertex 2*c* of the flipping member 2 and the vertex 3*c* of the flipping member 3 approach each other. The flipping members 2 and 3 are restricted to a state in which the distance between the vertexes 2*c* and 3*c* is maintained to be less than the diameter of the spherical body B.

First, the user loads the spherical body B into the launching port 1*c* inside the toy body 1 placed on the base plane. Then, the flipping members 2 and 3 are restricted by operating the restriction members 16L and 16R so as to be pushed into the toy body 1 from the top while holding down the toy body 1 with the hands. Subsequently, the spherical body B is moved toward the tips of the flipping members 2 and 3 using the pushing member 5.

Since the subsequent operation is substantially the same as that of the first embodiment, a detailed description thereof will be omitted here.

(Second Modification)

Figure 5:
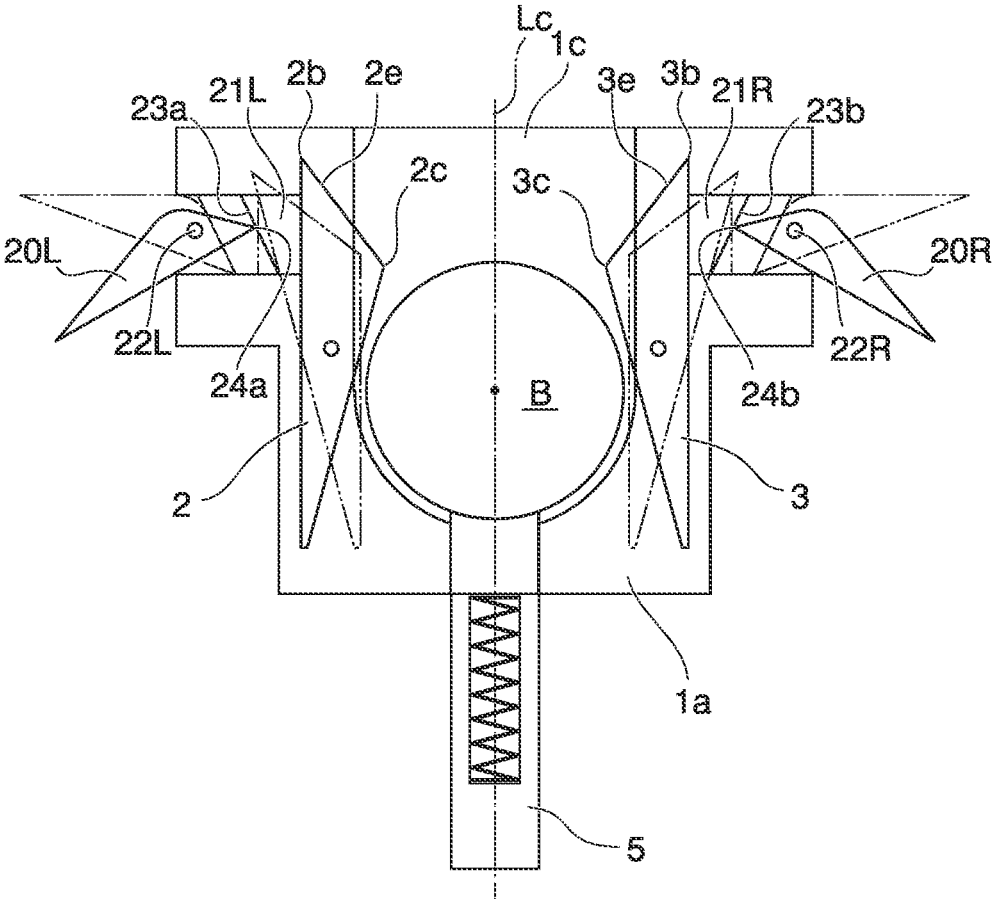
FIG. 5 is a plan cross-sectional view showing a second modification of the first embodiment.

As shown in FIG. 5, a second modification of the first embodiment includes levers (restriction members in the invention) 20L and 20R, and intermediate portions 21L and 21R.

The lever 20L is disposed on the left side of the launching port 1*c* in the launching direction of the spherical body B and outside the flipping member 2 with respect to the launching port 1*c*, and is pivotally supported within the imaginary horizontal plane by a pin 22L to the base 1*a*.

The intermediate portion 21L is formed integrally with the flipping member 2, and projects toward one end 24*a* of the lever 20L. A side portion of the intermediate portion 21L is formed with a backward slope 23*a* that becomes more distant from the flipping member 2 as it goes forward in the launching direction of the spherical body B. One end 24*a* of the lever 20L near the pin 22L abuts against the slope 23*a*. If the other end of the lever 20L is operated so as to be pulled backward, one end 24*a* of the lever 20L pushes the slope 23*a* of the intermediate portion 21L. That is, the rotation of the lever 20L is converted into lateral movement of the flipping member 2, having the intermediate portion 21L formed thereat, via one end 24*a* of the lever 20L and the slope 23*a*. Accordingly, the tip portion of the flipping member 2 moves toward the launching port 1*c*.

The lever 20R is disposed on the right side of the launching port 1*c* in the launching direction of the spherical body B and outside the flipping member 3 with respect to the launching port 1*c*, and is pivotally supported within the imaginary horizontal plane by a pin 22R to the base 1*a*.

The intermediate portion 21R is formed integrally with the flipping member 3, and projects toward one end 24*b* of the lever 20R. A side portion of the intermediate portion 21R is formed with a backward slope 23*b* that becomes more distant from the flipping member 3 as it goes forward in the launching direction of the spherical body B. One end 24*b* of the lever 20R near the pin 22R abuts against the slope 23*b*. If the other end of the lever 20R is operated so as to be pulled backward, one end 24*b* of the lever 20R pushes the slope 23*b* of the intermediate portion 21R. That is, the rotation of the lever 20R is converted into lateral movement of the flipping member 3, having the intermediate portion 21R formed thereat, via one end 24*b* of the lever 20R and the slope 23*b*. Accordingly, the tip portion of the flipping member 3 moves toward the launching port 1*c*.

The levers 20L and 20R are arranged on both sides of the toy body 1 across the launching port 1*c*, and a direction in which the other end of the lever 20L is pulled and a direction in which the other end of the lever 20R is pulled coincide with each other. Therefore, it is easy to simultaneously operate the levers 20L and 20R. If the levers 20L and 20R are simultaneously operated, the vertex 2*c* of the flipping member 2 and the vertex 3*c* of the flipping member 3 approach each other. The flipping members 2 and 3 are restricted to a state in which the distance between the vertexes 2*c* and 3*c* is maintained to be less than the diameter of the spherical body B.

First, the user loads the spherical body B into the launching port 1*c* inside the toy body 1 placed on the base plane. Then, the flipping members 2 and 3 are restricted by operating the other ends of the levers 20L and 20R so as to be pulled backward while holding down the toy body 1 with the hands. Subsequently, the spherical body B loaded into the launching port 1*c* is moved toward the tips of the flipping members 2 and 3 using the pushing member 5.

Since the subsequent operation is substantially the same as that of the first embodiment, a detailed description thereof will be omitted here.

(Third Modification)

Figure 6:
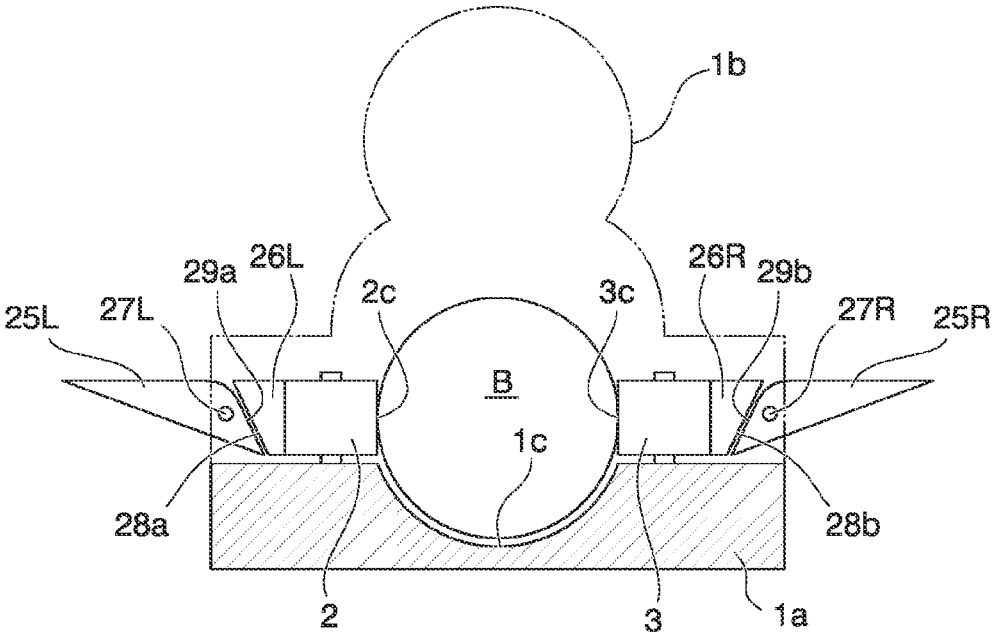
FIG. 6 is a longitudinal cross-sectional view in the width direction showing a third modification of the first embodiment.

As shown in FIG. 6, a third modification of the first embodiment includes levers 25L and 25R and intermediate portions 26L and 26R.

The lever 25L is disposed on the left side of the launching port 1*c* in the launching direction of the spherical body B and outside the flipping member 2 with respect to the launching port 1*c*, and is pivotally supported within an imaginary vertical plane by a pin 27L to the base 1*a*.

The intermediate portion 26L is formed integrally with the flipping member 2, and projects toward one end 29*a* of the lever 25L near the pin 27L. A side portion of the intermediate portion 26L is formed with a downward slope 28*a* that becomes more distant from the flipping member 2 as it goes upward. One end 29*a* of the lever 25L abuts against the slope 28*a*. If the other end of the lever 25L is operated so as to be toppled downward, one end 29*a* of the lever 25L pushes the slope 28*a* of the intermediate portion 26L. That is, the rotation of the lever 25L is converted into lateral movement of the flipping member 2, having the intermediate portion 26L formed thereat, via one end 29*a* of the lever 25L and the slope 28*a*. Accordingly, the tip portion of the flipping member 2 moves toward the launching port 1*c*.

The lever 25R is disposed on the right side of the launching port 1*c* in the launching direction of the spherical body B and outside the flipping member 3 with respect to the launching port 1*c*, and is pivotally supported within the imaginary horizontal plane by a pin 27R to the base 1*a*.

The intermediate portion 26R is formed integrally with the flipping member 3, and projects toward one end 29*b* of the lever 25R near the pin 27R. A side portion of the intermediate portion 26R is formed with a downward slope 28*b* that becomes more distant from the flipping member 3 as it goes upward. One end 29*b* of the lever 25R abuts against the slope 28*b*. If the other end of the lever 25R is operated so as to be toppled downward, one end 29*b* of the lever 25R pushes the slope 28*b* of the intermediate portion 26R. That is, the rotation of the lever 25R is converted into lateral movement of the flipping member 3, having the intermediate portion 26R formed thereat, via one end 29*b* of the lever 25R and the slope 28*b*. Accordingly, the tip portion of the flipping member 3 moves toward the launching port 1*c*.

The levers 25L and 25R are arranged on both sides of the toy body 1 across the launching port 1*c*, and a direction in which the lever 25L is toppled and a direction in which the lever 25R is toppled coincide with each other. Therefore, it is easy to simultaneously operate the levers 25L and 25R. If the levers 25L and 25R are simultaneously operated, the vertex 2*c* of the flipping member 2 and the vertex 3*c* of the flipping member 3 approach each other. The flipping members 2 and 3 are restricted to a state in which the distance between the vertexes 2*c* and 3*c* is maintained to be less than the diameter of the spherical body B.

First, the user loads the spherical body B into the launching port 1*c* inside the toy body 1 placed on the base plane. Then, the flipping members 2 and 3 are restricted by operating the other ends of the levers 25L and 25R so as to be toppled downward while holding down the toy body 1 with the hands. Subsequently, the spherical body B loaded into the launching port 1*c* is moved toward the tips of the flipping members 2 and 3 using the pushing member 5.

Since the subsequent operation is substantially the same as that of the first embodiment, a detailed description thereof will be omitted here.

(Fourth Modification)

Figure 7:
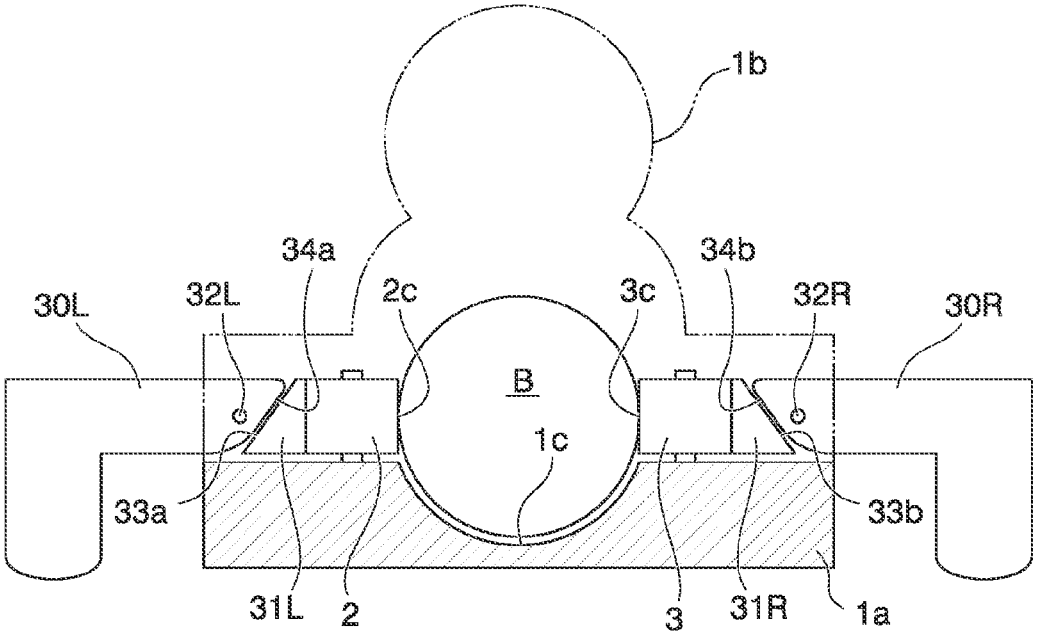
FIG. 7 is a longitudinal cross-sectional view in the width direction showing a fourth modification of the first embodiment.

As shown in FIG. 7, a fourth modification of the first embodiment includes levers 30L and 30R and intermediate portions 31L and 31R.

The lever 30L is disposed on the left side of the launching port 1*c* in the launching direction of the spherical body B and outside the flipping member 2 with respect to the launching port 1*c*, and is pivotally supported within the imaginary vertical plane by a pin 32L to the base 1*a*.

The intermediate portion 31L is formed integrally with the flipping member 2, and projects toward one end 34*a* of the lever 30L near the pin 32L. A side portion of the intermediate portion 31L is formed with an upward slope 33*a* that becomes more distant from the flipping member 2 as it goes downward. One end 34*a* of the lever 30L abuts against the slope 33*a*. The other end of the lever 30L is formed so as to be bent downward. If the other end of the lever 30L is operated so as to be toppled upward, one end 34*a* of the lever 30L pushes the slope 33*a* of the intermediate portion 31L. That is, the rotation of the lever 30L is converted into lateral movement of the flipping member 2, having the intermediate portion 31L formed thereat, via one end 34*a* of the lever 30L and the slope 33*a*. Accordingly, the tip portion of the flipping member 2 moves toward the launching port 1*c*.

The lever 30R is disposed on the right side of the launching port 1*c* in the launching direction of the spherical body B and outside the flipping member 3 with respect to the launching port 1*c*, and is pivotally supported within the imaginary horizontal plane by a pin 32R to the base 1*a*.

The intermediate portion 31R is formed integrally with the flipping member 2, and projects toward one end 34*b* of the lever 30R near the pin 32R. A side portion of the intermediate portion 31R is formed with an upward slope 33*b* that becomes more distant from the flipping member 3 as it goes downward. One end 34*b* of the lever 30R abuts against the slope 33*b*. The other end of the lever 30R is formed so as to be bent downward. If the other end of the lever 30R is operated so as to be topped upward, one end 34*b* of the lever 30R pushes the slope 33*b* of the intermediate portion 31R, and the rotation of the lever 30R is converted into lateral movement of the flipping member 3, having the intermediate portion 31R formed thereat, via one end 34*b* of the lever 30R and the slope 33*b*. Accordingly, the tip portion of the flipping member 3 moves toward the launching port 1*c*.

Since the levers 30L and 30R are arranged on both sides of the toy body 1 across the launching port 1*c*, if the levers 30L and 30R are simultaneously operated, the vertex 2*c* of the flipping member 2 and the vertex 3*c* of the flipping member 3 approach each other. The flipping members 2 and 3 are restricted to a state in which the distance between the vertexes 2*c* and 3*c* is maintained to be less than the diameter of the spherical body B.

First, the user loads the spherical body B into the launching port 1*c* inside the toy body 1 placed on the base plane. Then, if the toy body 1 is held down with the hands, the other ends of the levers 30L and 30R that are bent downward abut against the base plane, and the levers 30L and 30R are rotated upward by reaction forces acting on the levers 30L and 30R from the base plane. This restricts the flipping members 2 and 3. Subsequently, the spherical body B loaded into the launching port 1*c* is moved toward the tips of the flipping members 2 and 3 using the pushing member 5.

Since the subsequent operation is substantially the same as that of the first embodiment, a detailed description thereof will be omitted here.

Particularly, according to this fourth modification, the flipping members 2 and 3 are restricted simply by holding down the toy body 1 placed on the base plane with the hands. Thus, it is possible to operate the game-piece launching toy even with a single hand.

(Fifth Modification)

Figure 8:
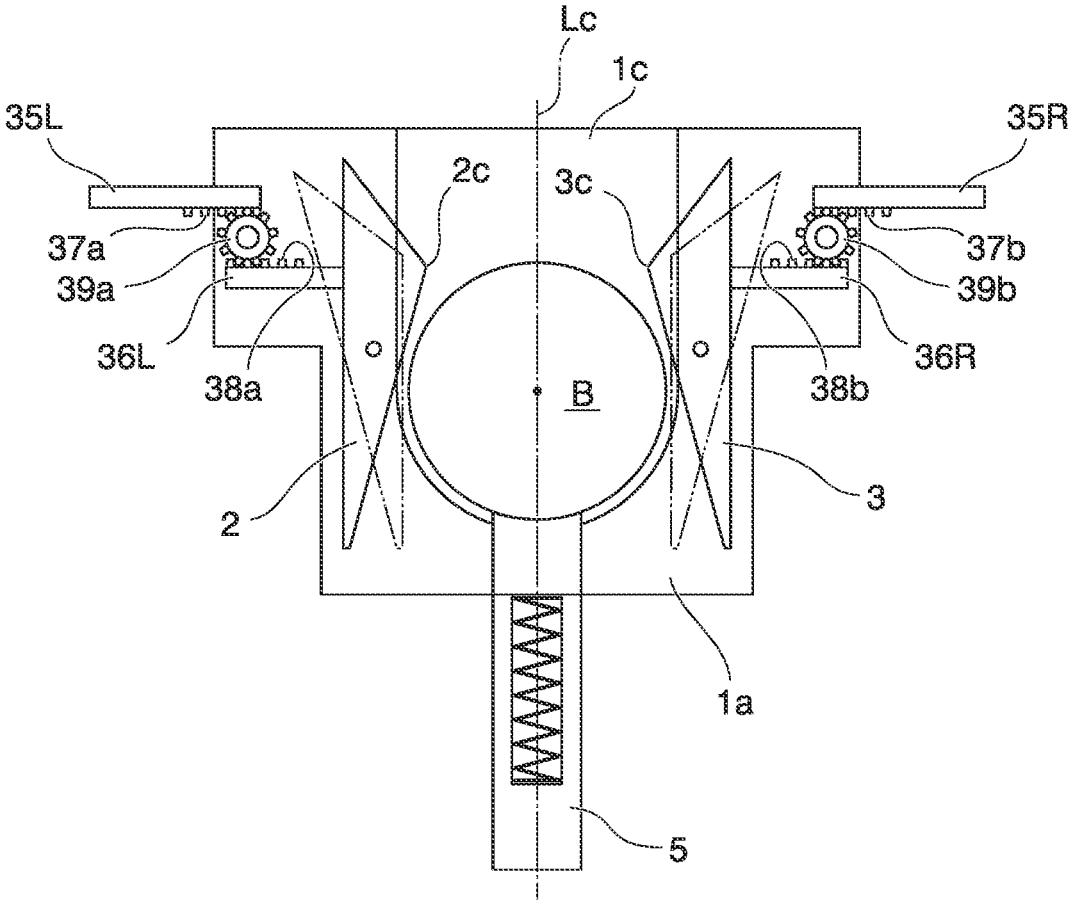
FIG. 8 is a plan cross-sectional view showing a fifth modification of the first embodiment.

As shown in FIG. 8, a fifth modification of the first embodiment includes tab members (restriction members in the invention) 35L and 35R, and intermediate portions 36L and 36R.

The tab member 35L is disposed on the left side of the launching port 1*c* in the launching direction of the spherical body B and outside the flipping member 2 with respect to the launching port 1*c*, and is supported by the base 1*a* so as to be slidable in a direction (that is, the lateral direction) orthogonal to the launching direction of the spherical body B. One end of the tab member 35L projects from the toy body 1. The other end of the tab member 35L is formed with a rack 37*a*.

The intermediate portion 36L is formed integrally with the flipping member 2 so as to become parallel to the tab member 35L. A rack 38*a* is formed at the intermediate portion 36L so as to face the rack 37*a*. A pinion gear 39*a* engaged with the racks 37*a* and 38*a* is pivotally supported to the base 1*a*. If the other end of the tab member 35L is operated so as to be pulled out from the toy body 1, displacement of the tab member 35L is transmitted to the intermediate portion 36L via the rack 37*a*, the pinion gear 39*a*, and the rack 38*a*, and is converted into a movement in the lateral direction of the flipping member 2 having the intermediate portion 36L formed thereat, that is, in a direction opposite to the tab member 35L. Accordingly, the tip portion of the flipping member 2 moves toward the launching port 1*c*.

The tab member 35R is disposed on the right side of the launching port 1*c* in the launching direction of the spherical body B and outside the flipping member 3 with respect to the launching port 1*c*, and is supported by the base 1*a* so as to be slidable in the direction (that is, the lateral direction) orthogonal to the launching direction of the spherical body B. One end of the tab member 35R projects from the toy body 1. The other end of the tab member 35R is formed with a rack 37*b*.

The intermediate portion 36R is formed integrally with the flipping member 3 so as to become parallel to the tab member 35R. A rack 38*b* is formed at the intermediate portion 36R so as to face the rack 37*b*. A pinion gear 39*b* engaged with the racks 37*b* and 38*b* is pivotally supported to the base 1*a*. If the other end of the tab member 35R is operated so as to be pulled out from the toy body 1, displacement of the tab member 35R is transmitted to the intermediate portion 36R via the rack 37*b*, the pinion gear 39*b*, and the rack 38*b*, and is converted into a movement in the lateral direction of the flipping member 3 having the intermediate portion 36R formed thereat, that is, in a direction opposite to the tab member 35R. Accordingly, the tip portion of the flipping member 3 moves toward the launching port 1*c*.

Since the tab members 35L and 35R are arranged on both sides of the toy body 1 across the launching port 1*c*, if the tab members 35L and 35R are simultaneously operated, the vertex 2*c* of the flipping member 2 and the vertex 3*c* of the flipping member 3 approach each other. The flipping members 2 and 3 are restricted to a state in which the distance between the vertexes 2*c* and 3*c* is maintained to be less than the diameter of the spherical body B.

First, the user loads the spherical body B into the launching port 1*c* inside the toy body 1 placed on the base plane. Then, the flipping members 2 and 3 are restricted by operating the tab members 35L and 35R so as to be pulled out from the toy body 1. Subsequently, the spherical body B is moved toward the tips of the flipping members 2 and 3 using the pushing member 5.

Since the subsequent operation is substantially the same as that of the first embodiment, a detailed description thereof will be omitted here.

(Sixth Modification)

Figure 9:
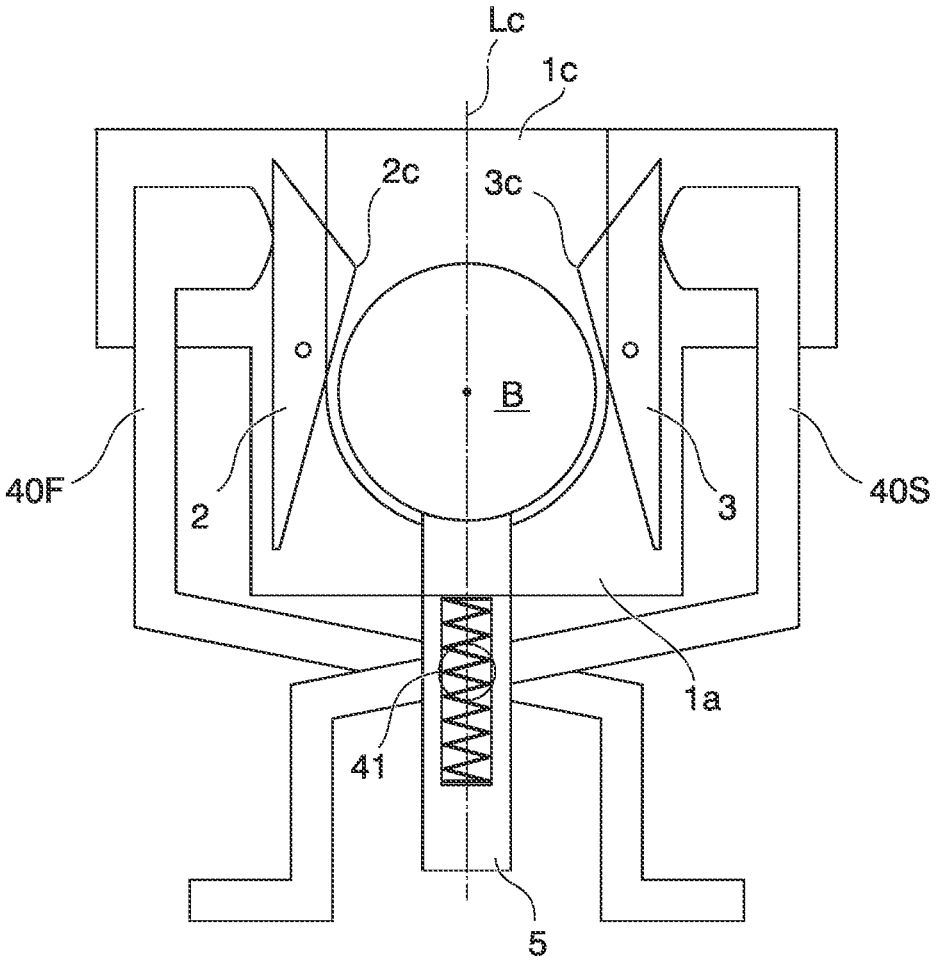
FIG. 9 is a plan cross-sectional view showing a sixth modification of the first embodiment.

As shown in FIG. 9, a sixth modification of the first embodiment includes first and second bars (restriction members in the invention) 40F and 40S. The two bars 40F and 40S are combined via a pin 41 fixed to a rear portion of the base 1*a* with respect to the launching port 1*c*.

A tip of the first bar 40F extends toward the left side of the launching port 1*c* in the launching direction of the spherical body B, and abuts against the outside of the flipping member 2. Meanwhile, a tip of the second bar 40S extends toward the right side of the launching port 1*c* in the launching direction of the spherical body B, and abuts against the outside of the flipping member 3. A base end of the first bar 40F extends to the right side of the launching port 1*c* via the pin 41, and a base end of the second bar 40S extends to the left side of the launching port 1*c* via the pin 41.

If the base ends of the first and second bars 40F and 40S are brought close to each other, the tips of the first and second bars 40F and 40S pinch the flipping members 2 and 3, and the vertex 2*c* of the flipping member 2 and the vertex 3*c* of the flipping member 3 approach each other. The flipping members 2 and 3 are restricted to a state in which the distance between the vertexes 2*c* and 3*c* is maintained to be less than the diameter of the spherical body B.

First, the user loads the spherical body B into the launching port 1*c* inside the toy body 1 placed on the base plane. Then, the index finger and the middle finger are hooked to the base ends of the first and second bars 40F and 40S. Subsequently, the pushing member 5 is pushed into the toy body 1 using the thumb. At this time, the tips of the first and second bars 40F and 40S are operated by reaction forces acting on the base ends of the first and second bars 40F and 40S from the index finger and the middle finger so as to approach each other. This restricts the flipping members 2 and 3. Subsequently, the spherical body B loaded into the launching port 1*c* is moved toward the tips of the flipping members 2 and 3 using the pushing member 5.

Since the subsequent operation is substantially the same as that of the first embodiment, a detailed description thereof will be omitted here.

Particularly, according to the sixth modification, it is possible to operate the game-piece launching toy even with single hand, as if operating a syringe.

(Seventh Modification)

Figure 10:
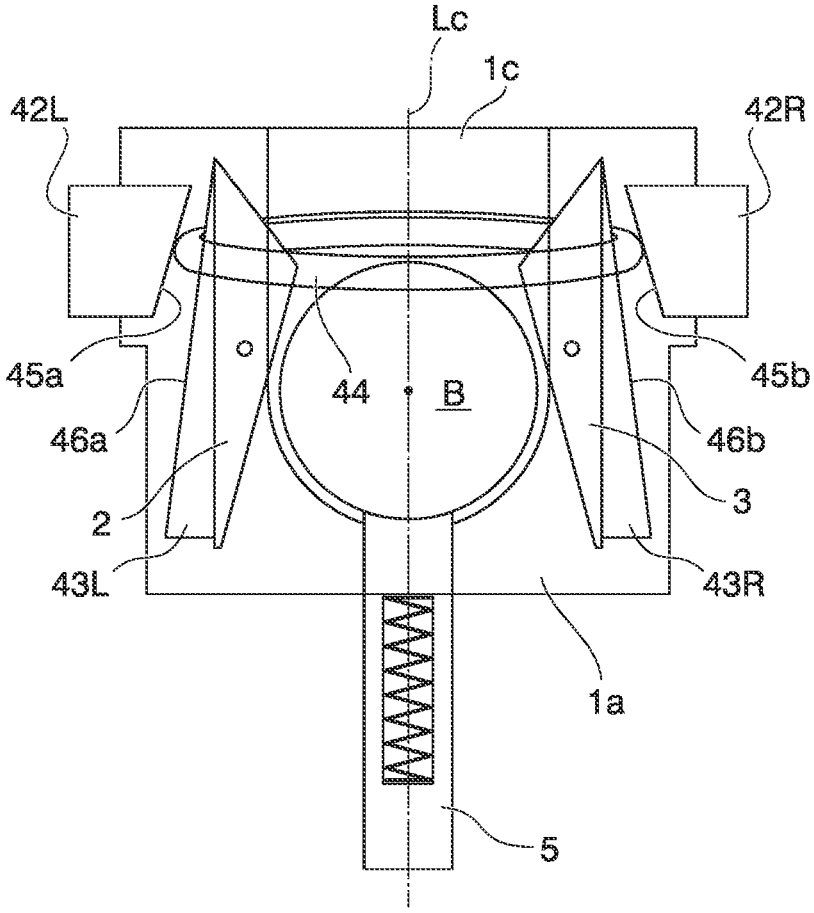
FIG. 10 is a plan cross-sectional view showing a seventh modification of the first embodiment.

As shown in FIG. 10, a seventh modification of the first embodiment includes restriction members 42L and 42R, intermediate portions 43L and 43R, and a ring member 44.

The restriction member 42L is disposed on the left side of the launching port 1*c* in the launching direction of the spherical body B and outside the flipping member 2 with respect to the launching port 1*c*, and is supported by the base 1*a* so as to be movable in a direction (that is, the lateral direction) orthogonal to the launching direction of the spherical body B. A slope 45*a* approaching the centerline Lc of the base 1*a* as it goes forward in the launching direction of the spherical body B is formed on the inside of the restriction member 42L.

On the other hand, the restriction member 42R is disposed on the right side of the launching port 1*c* in the launching direction of the spherical body B and outside the flipping member 3 with respect to the launching port 1*c*, and is supported by the base 1*a* so as to be movable in a direction (that is, the lateral direction) orthogonal to the launching direction of the spherical body B. A slope 45*b* approaching the centerline Lc of the base 1*a* as it goes forward in the launching direction of the spherical body B is formed on the inside of the restriction member 42R.

The intermediate portion 43L is formed integrally with the flipping member 2. The intermediate portion 43L is formed with a slope 46*a* that becomes more distant from the flipping member 2 as it goes backward in the launching direction of the spherical body B. On the other hand, the intermediate portion 43R is formed integrally with the flipping member 3. The intermediate portion 43R is formed with a slope 46*b* that becomes more distant from the flipping member 3 as it goes backward in the launching direction of the spherical body B.

The ring member 44 is arranged between the restriction members 42L and 42R so that the center of the ring member 44 is parallel to the centerline Lc, and is movable in the direction opposite to the launching direction of the spherical body B with respect to the base 1*a*. An outer periphery of the ring member 44 abuts against the slopes 45*a* and 45*b* of the restriction members 42L and 42R, and an inner periphery of the ring member 44 abuts against the slopes 46*a* and 46*b* of the intermediate portions 43L and 43R.

The restriction members 42L and 42R are arranged on both sides of the toy body 1 across the launching port 1*c*, and the direction in which the restriction member 42L is pushed and the direction in which the restriction member 42R is pushed coincide with each other. If the restriction members 42L and 42R are simultaneously operated, both approach each other and the spacing between the slope 45*a* of the restriction member 42L and the slope 45*b* of the restriction member 42R is narrowed. If the spacing between the slopes 45*a* and 45*b* is narrowed, the ring member 44 moves backward in the launching direction of the spherical body B and causes the flipping members 2 and 3 to approach each other via the intermediate portions 43L and 43R. Accordingly, the flipping members 2 and 3 are restricted to a state in which the distance between the vertexes 2*c* and 3*c* is maintained to be less than the diameter of the spherical body B.

First, the user loads the spherical body B into the launching port 1*c* inside the toy body 1 placed on the base plane. Then, flipping members 2 and 3 are restricted by operating the restriction members 42 and 42 so as to be pushed into the toy body 1 from both sides of the toy body 1 while holding down the toy body 1 with the hands. Subsequently, the spherical body B is moved toward the tips of the flipping members 2 and 3 using the pushing member 5.

Since the subsequent operation is substantially the same as that of the first embodiment, a detailed description thereof will be omitted here.

(Eighth Modification)

Figure 11:
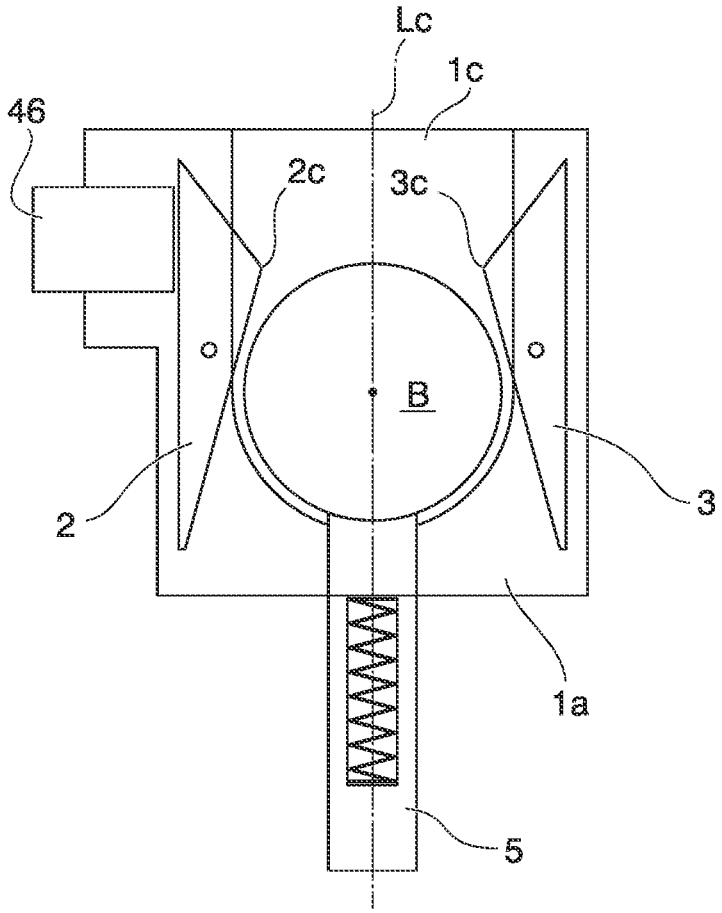
FIG. 11 is a plan cross-sectional view showing an eighth modification of the first embodiment.

As shown in FIG. 11, an eighth modification of the first embodiment includes a restriction member 46. In addition, one flipping member 3 out of the two flipping members 2 and 3 is fixed in place.

The restriction member 46 is disposed on the left side of the launching port 1*c* in the launching direction of the spherical body B and outside the flipping member 2 with respect to the launching port 1*c*, and is supported by the base 1*a* so as to be movable in a direction (that is, the lateral direction) orthogonal to the launching direction of the spherical body B.

First, the user loads the spherical body B into the launching port 1*c* inside the toy body 1 placed on the base plane. Then, the flipping member 2 is restricted by operating the restriction member 46 so as to be pushed into the toy body 1 from a side while holding down the toy body 1 with the hands. Subsequently, the spherical body B is moved toward the tips of the flipping members 2 and 3 using the pushing member 5.

Since the subsequent operation is substantially the same as that of the first embodiment, a detailed description thereof will be omitted here.

In the first embodiment of the invention including the first to eighth modifications, the flipping members 2 and 3 are pivotally supported by the pins 4L and 4R. Incidentally, the two flipping members that make a pair may be constituted by one part formed in a circular-arc shape as in the related art. In this case, the distance between the tips of the flipping members 2 and 3 is preferably greater than the diameter of the spherical body B. Thus, if the forces applied to the restriction members are weakened after the spherical body B is launched from the toy body 1, the flipping members 2 and 3 try to return to their initial positions by the elastic restoring force of the circular-arc-shaped part, and consequently also return the restriction members to their initial positions.

Second Embodiment

Figure 12:
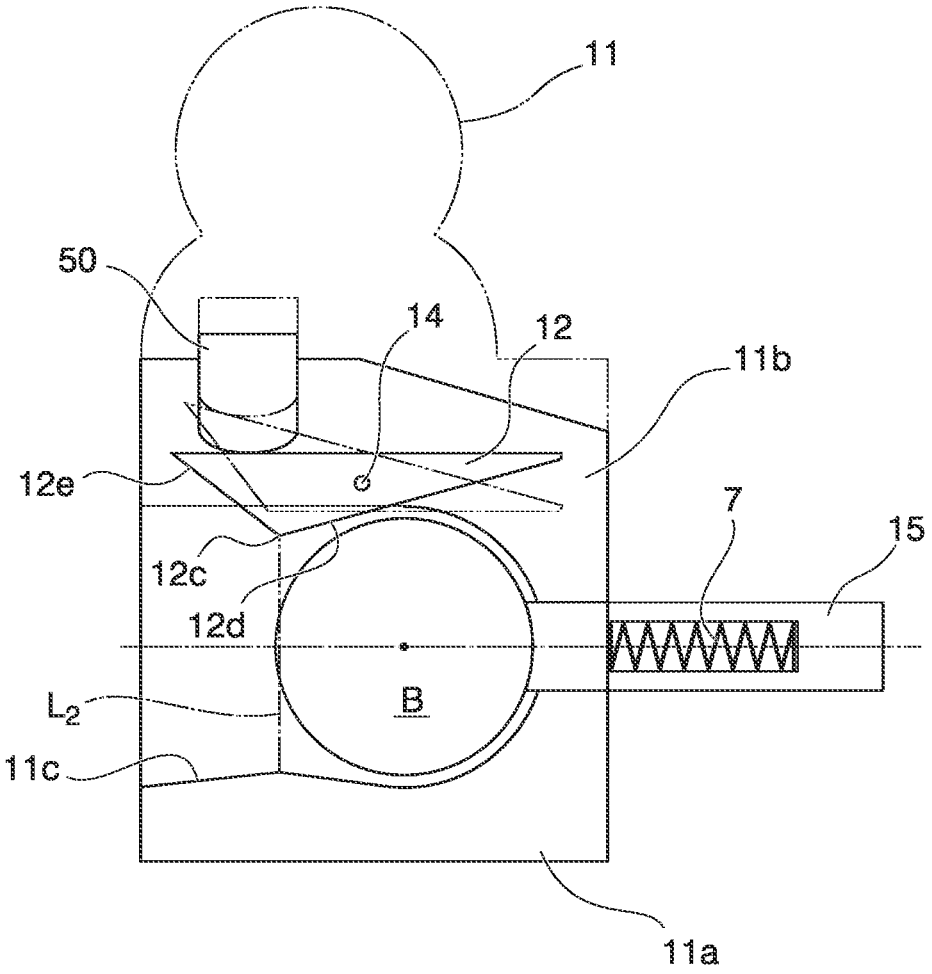
FIG. 12 is a longitudinal cross-sectional view in a longitudinal direction showing a second embodiment of the game-piece launching toy of the invention.

A second embodiment of a game-piece launching toy of the invention, which is shown in FIG. 12, will be described below.

The second embodiment of the invention includes a toy body 11, one flipping member 12 that launches the spherical body B as a game-piece, a pushing member 15 that pushes the spherical body B loaded into the toy body 1, and a restriction member 50 that restricts a tip of the flipping member 12. All of the flipping member 12, the pushing member 15, and the restriction member 50 are attached to the toy body 11.

A base 11*a* of the toy body 11 is formed with a launching port 11*c* for the spherical body B. The flipping member 12 is pivotally supported within the imaginary vertical plane by a pin 14 fixed to an upper part of the base 11*a*. Since the shape of the flipping member 12 is the same as that of the flipping members 2 and 3 in the first embodiment, a detailed description thereof will be omitted here.

The spacing between the launching port 11*c* and the pin 14 is clearly greater than the diameter of the spherical body B, and the spherical body B placed on the launching port 11*c* is movable toward the tip of the flipping member 12 between the flipping member 12 supported by the pin 14 and the launching port 11*c*.

Since the structure of the pushing member 15 is the same as that of the pushing member 5 in the first embodiment, a detailed description thereof will also be omitted here.

The restriction member 50 is disposed above the flipping member 12 with respect to the launching port 11*c*, and is supported by an upper member 11*b* so as to be movable in the direction (that is, the vertical direction) orthogonal to the launching direction of the spherical body B. If the restriction member 50 is pushed into the toy body 11, a tip of the restriction member 50 abuts against an upper edge of the flipping member 12, and a tip portion of the flipping member 12 is rotated toward the launching port 11*c*.

If the restriction member 50 is operated, a vertex 12*c* of the flipping member 12 approaches the launching port 11*c*. The flipping member 12 is restricted to a state in which the spacing between the vertex 12*c* and the launching port 11*c* is maintained to be less than the diameter of the spherical body B.

The user loads the spherical body B into the launching port 11*c* inside the toy body 11 placed on the base plane. Then, the flipping member 12 is restricted by operating the restriction member 50 so as to be pushed into the toy body 11 from the top while holding down the toy body 11 with the hands. Accordingly, the spacing between the peak 12*c* and the launching port 11*c* becomes less than the diameter of the spherical body B.

Subsequently, the spherical body B loaded into the launching port 11*c* is moved toward the tip of the flipping member 12 using the pushing member 15. The spherical body B is pushed by the pushing member 15, is moved forward in the launching direction on the launching port 11*c*, and abuts against a rear oblique side 12*d* of the flipping member 12. Meanwhile, since the flipping member 12 is restricted by the user's hands via the restriction member 50, a force checking the movement of the spherical body B using the pushing member 15 acts on the flipping member 12. If the spherical body B is further moved toward the tip of the flipping member 12 against the force, since the spherical body B abuts against the rear oblique side 12*d* of the flipping member 12, the tip portion of the flipping member 12 is displaced against the restriction forces generated by the user's hands so as to widen the spacing between the vertex 12*c* and the launching port 11*c*. Then, if the center of the spherical body B moves forward further than an imaginary vertical line L2 drawn down from the vertex 12*c* to the launching port 11*c*, the spherical body B abuts against the front oblique side 12*e* of the flipping member 12, and is launched forward in the launching direction from the toy body 11 by the restriction force acting on the flipping member 12 by the user's hands.

According to the game-piece launching toy configured as mentioned above, when a user operates the restriction member 50 while holding down the game-piece launching toy with the hands, the restriction force acting on the flipping member 12 can be adjusted by adjusting the force input to the restriction member 50 by user's hands. That is, since the user can arbitrarily adjust the force launching the spherical body B from the toy body 11, changes can be made to the speed of the spherical body B to be launched from the toy body 11. As a result, the range of play using the game-piece launching toy is broad, and the user's enjoyment is enhanced.

Additionally, in the first embodiment of the invention including the first to eighth modifications and the second embodiment, the launching toy using the spherical body B as a game-piece for play has been described. However, an object that can be used for the game-piece is not the spherical body only. For example, anything is available if objects including a round surface on a portion of the surface thereof, such as a disk, are adopted.

Although the preferred embodiments of the invention have been described, the invention is not limited to the above embodiments. Additions, omissions, substitutions, and other modifications of components can be made without departing from the concept of the present invention. The invention is not to be considered as being limited by the foregoing description, and is limited only by the scope of the appended claims.

INDUSTRIAL APPLICABILITY

The invention relates to a game-piece launching toy including a toy body; a flipping member installed on the toy body; a pushing member configured to move a game-piece placed on the toy body toward a tip of the flipping member; and a restriction member installed on the toy body to be movable with respect to the toy body and operated by a user to restrict the flipping member, the game-piece being launched using a restriction force acting on the flipping member.

According to the invention, since a user can arbitrarily adjust the force launching the game-piece from the toy body, the range of play using the game-piece launching toy is broad, and the user's enjoyment is enhanced.

REFERENCE SIGNS LIST

1: TOY BODY
2, 3: FLIPPING MEMBER
5: PUSHING MEMBER
10L, 10R: RESTRICTION MEMBER
11: TOY BODY
12: FLIPPING MEMBER
15: PUSHING MEMBER
50: RESTRICTION MEMBER
B: SPHERICAL BODY (GAME-PIECE)

The invention claimed is:

1. A game-piece launching toy comprising:
a toy body;
a flipping member installed on the toy body;
a pushing member configured to move a game-piece placed on the toy body toward a tip of the flipping member; and
a restriction member installed on the toy body to be movable with respect to the toy body and operated by a user to restrict the flipping member,
wherein the game-piece is launched using a restriction force acting on the flipping member.

2. The game-piece launching toy according to claim 1,
wherein the toy body is provided with a pair of the flipping members, and
wherein the restriction member restricts the pair of the flipping members so as to make a distance between tips of the flipping members less than a breadth of the game-piece.

3. The game-piece launching toy according to claim 1,
wherein the flipping member is provided with an intermediate portion interposed between the flipping member and the restriction member, and
wherein the intermediate portion changes a direction of a force acting on the intermediate portion from the restriction member and thereafter transmits the force to the flipping member.

4. The game-piece launching toy according to claim 1,
wherein the restriction member is supported so as to be allowed to be pushed down with respect to the toy body.

5. The game-piece launching toy according to claim 1,
wherein the restriction member is a lever member supported by the toy body so as to be rotatable.

6. The game-piece launching toy according to claim 1, further comprising:
racks formed on the restriction member and the intermediate portion; and
a pinion gear disposed between the restriction member and the intermediate portion and engaged with the racks.

7. The game-piece launching toy according to claim 1,
wherein the restriction member includes first and second bars that are pin-connected to each other, and
wherein base ends of the first and second bars are operated to pinch and restrict the flipping member with tips of the first and second bars.

8. The game-piece launching toy according to claim 1,
wherein the restriction member further includes a ring member supported so as to be movable in a direction opposite to a launching direction of the game-piece according to a pushing-down movement of the restriction member.

9. The game-piece launching toy according to claim 1,
wherein the restriction member restricts the flipping member so as to make a spacing between the toy body having the game-piece placed thereon and a tip of the flipping member less than a breadth of the game-piece.

10. The game-piece launching toy according to claim 9,
wherein the restriction member is supported so as to be allowed to be pushed down with respect to the toy body.

* * * * *